US010106920B2

(12) United States Patent
Zhang

(10) Patent No.: US 10,106,920 B2
(45) Date of Patent: Oct. 23, 2018

(54) PRODUCTION METHOD OF SUPERCLEAN WIPER

(71) Applicant: Guangdong Suorec Technology Co. Ltd., Guangdong (CN)

(72) Inventor: Jun Zhang, Dongguan (CN)

(73) Assignee: Guangdong Suorec Technology Co., Ltd., Guangdong (CN)

( * ) Notice: Subject to any disclaimer, the term of this patent is extended or adjusted under 35 U.S.C. 154(b) by 505 days.

(21) Appl. No.: 14/758,182

(22) PCT Filed: Sep. 2, 2013

(86) PCT No.: PCT/CN2013/001032

§ 371 (c)(1),
(2) Date: Jun. 26, 2015

(87) PCT Pub. No.: WO2014/101261

PCT Pub. Date: Jul. 3, 2014

(65) Prior Publication Data

US 2016/0194789 A1 Jul. 7, 2016

(30) Foreign Application Priority Data

Dec. 26, 2012 (CN) ..... 2012 1 0574599

(51) Int. Cl.
*D03D 1/00* (2006.01)
*D06B 1/02* (2006.01)
(Continued)

(52) U.S. Cl.
CPC ..... *D03D 1/0023* (2013.01); *A47L 1/15* (2013.01); *A47L 13/08* (2013.01); *A47L 13/16* (2013.01);
(Continued)

(58) Field of Classification Search
CPC ... D06B 1/02; D06B 1/14; D06B 3/20; D06B 3/201; D06B 5/08; D06B 9/00;
(Continued)

(56) References Cited

U.S. PATENT DOCUMENTS 2,712,683 A * 7/1955 Gaunt et al. ..... D06B 9/00 28/159
3,902,299 A * 9/1975 Zeidell ..... A47L 13/16 15/208
(Continued)

FOREIGN PATENT DOCUMENTS

CN 101507587 A 8/2009
CN 101744594 A 6/2010
(Continued)

*Primary Examiner* — Amy Vanatta
(74) *Attorney, Agent, or Firm* — Muncy, Geissler, Olds & Lowe, P.C.

(57) ABSTRACT

Disclosed is a production method of superclean wiping cloth, including the steps of choosing filament, weaving, removing oligomers and dust particles through rinsing process, dehydrating, setting, cutting, washing, drying, and packaging; wherein removing oligomers and dust particles through rinsing process is the key process, the airflow rinsing machine is used to rinse the gray fabric, avoiding the reverse contamination and cloth damage during washing, ensuring a high cleanliness of the gray fabric. Excellent effect of removing oligomers and dust particles will be achieved through adding degreasers of specific formula, in a clean environment, at a specific temperature, whereby a wiping cloth product with stable quality, i.e., real superclean wiping cloth, will be obtained. The rising process is simple and highly efficient, it ensures the stability of product quality and high cleanliness, producing a superclean wiping cloth with high cleanliness and stable quality, using a simple and efficient production process.

10 Claims, 1 Drawing Sheet

(51) Int. Cl.

| | |
|---|---|
| ***D06L 1/20*** | (2006.01) |
| ***D06C 27/00*** | (2006.01) |
| ***A47L 1/15*** | (2006.01) |
| ***A47L 13/16*** | (2006.01) |
| ***D06B 1/14*** | (2006.01) |
| ***D06B 9/00*** | (2006.01) |
| ***A47L 13/08*** | (2006.01) |
| ***B08B 1/00*** | (2006.01) |

(52) U.S. Cl.
CPC ..... *B08B 1/006* (2013.01); *D06B 1/02* (2013.01); *D06B 1/14* (2013.01); *D06B 9/00* (2013.01); *D06C 27/00* (2013.01); *D06L 1/20* (2013.01)

(58) Field of Classification Search
CPC . D06B 9/04; D06B 3/10; D06B 15/10; D06B 21/00; D03D 1/00; D03D 1/0023; D03D 1/0017; D06L 1/20; D06C 27/00; D06C 29/00; D06C 7/02
USPC ..... 28/165, 167; 8/115.51, 137, 138, 139, 8/151, 147, 158, 159
See application file for complete search history.

(56) References Cited

U.S. PATENT DOCUMENTS

| | | | | | |
|---|---|---|---|---|---|
| 3,922,738 | A * | 12/1975 | Holm | D06B 9/04 | 68/19.1 |
| 4,081,976 | A * | 4/1978 | Moreinis-Eisen | D06B 3/26 | 118/53 |
| 5,320,900 | A * | 6/1994 | Oathout | A47L 13/16 | 15/210.1 |
| 5,736,469 | A * | 4/1998 | Bhattacharjee | B05D 5/12 | 15/209.1 |
| 6,189,189 | B1 * | 2/2001 | Morin | A47L 13/16 | 15/208 |
| 7,078,358 | B2 * | 7/2006 | Roberts | C11D 1/72 | 15/208 |
| 7,201,777 | B2 * | 4/2007 | Booker, Jr. | A41D 31/0011 | 264/171.1 |
| 2010/0215905 | A1 * | 8/2010 | Liou | A47L 13/16 | 428/156 |

FOREIGN PATENT DOCUMENTS

| | | | |
|---|---|---|---|
| CN | 102002846 | A | 4/2011 |
| CN | 102337650 | A | 2/2012 |
| CN | 103015081 | A | 4/2013 |

* cited by examiner

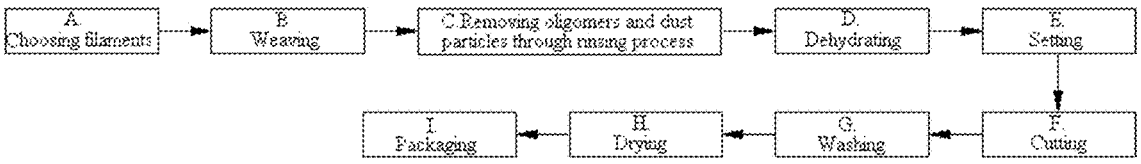
A.
Choosing filaments
B.
Weaving
C.Removing oligomers and dust particles through rinsing process
D.
Dehydrating
E.
Setting
F.
Cutting
G.
Washing
H.
Drying
I.
Packaging

PRODUCTION METHOD OF SUPERCLEAN WIPER

TECHNICAL FIELD

The present application relates to the technical field of superclean wiper, especially a production method of superclean wiper.

BACKGROUND OF THE INVENTION

Wiper have soft surfaces which are suitable for wiping the sensitive surface of object, they do not lose fibres during rub, and have good water-absorbing property and clean efficiency. In view of above advantages, the wiper are widely applied, e.g., in the fields of production lines of semiconductor chip, microprocessor, etc., disk driver, composite material, display product such as LCD, production line of circuit board, precise instrument, optical production, aviation industry, PCB product, medical instruments, laboratory, dust-free plant, etc. All the time nonvolatile residues and particles residues are significant factors effecting the application of wiper. The residual amount of the nonvolatile residues (NVR value) and the residual amount of the liquid particles residues (LPC value) affect the application scope of wiper. For example, in the optical industry, if the NVR value of wiper is too high, the light transmittance will be affected and the emission efficiency will be decreased, whereby many problems will be caused, such as high energy consumption of device, poor stability and display quality, etc. In high-end industries, the NVR value of wiper is normally required not more than 0.05 mg/g, and the LPC value is normally required not more than 50 counts/cm$^2$. The key process to affect the cleanliness of wiper is the rinsing process of woven grey fabric. In the current rinsing process, ordinary well water, river water or tap water, which contains large amount of ions and impurities, is generally used, this cannot enhance the cleanliness of cloth greatly. The improved rising process is normally as follows: injecting the pure water into an overflow rinsing vat, and adding some chemical detergents therein to rinse the grey fabric in an intermittent circulating rinse way. However because of the disadvantages of overflow machine itself, and low cleanliness of the water used, the cleanliness will varies largely in the produced wipers, so it is difficult to guarantee the production quality, that is, it is difficult to ensure the NVR value is not more than 0.05 mg/g, and LPC value is not more than 50 counts/cm$^2$. The wiper with low cleanliness has poor stain removal property, which will harm the devices, sensitive materials, etc., even shorten the service life of the devices and materials, if it is applied thereto in a long term.

Therefore, a superclean wiper with high cleanliness and stable quality, along with simple and efficient production process must be provided.

SUMMARY OF THE INVENTION

The object of the present invention is to provide a production method of superclean wiper, producing a superclean wiper with high cleanliness and stable quality, in a simple and efficient production process.

The present invention provides a production method of superclean wiper, comprising the steps of A. Choosing filaments: choosing continuous filament yarn above AA grade, wherein the oil content of yarn is lower than 1.5%;

B. Weaving: weaving the filament from step A to form a grey fabric, in environment of ISO 1 to ISO 9 class according to ISO 14644-1 standard, the fabric is woven by a weave of 28-42 stitches, a double weave, a weave of 1/1, 1/2 or 1/3, or any combination thereof;

C. Removing oligomers and particles through rinsing process: rinsing the grey fabric from step B circularly by high temperature pure water, using an airflow rinsing machine without reverse contamination as a boiling-off rinsing equipment, at a water temperature of 80° C. to 130° C., adding degreasers, such as surfactant, enzyme catalyst, sodium carbonate, sodium percarbonate, or sodium hydroxide, in order to remove oligomers, wherein the surfactant is 0.1% to 0.8% by weight, the sodium carbonate is 0.2% to 1% by weight, the sodium percarbonate is 0.2% to 1% by weight, the sodium hydroxide is 5 g/L to 20 g/L, the bath ratio of grey fabric to the rinsing solution is 1:3 to 1:10, removing oligomers and particles on the grey fabric in high temperature condition by using airflow rinsing machine;

D. Dehydrating: dehydrating the oligomer-free and dust-free grey fabric by using a rotating centrifugal purification dehydrator, removing ions, particles and other dirt from the fiber surfaces of grey fabric, wherein the rotating centrifugal purification dehydrator has a dehydrating part made of 316 stainless steel, the dehydrating rotating speed is 350 to 600 rpm;

E. Setting: setting the grey fabric by a dust-free and silicone oil-free setting machine in an environment above ISO 8 class according to ISO 14644-1 standard, in the totally enclosed mode, at a temperature from 160° C. to 210° C., with a setting speed of 30 to 60 m/min;

F. Cutting: putting the gray fabric after setting into a cleanroom above ISO 7 class according to ISO 14644-1 standard, cutting the grey fabric through ultrasonic wave cutting, laser cutting, or thermal cutting, to form a preliminary wiper;

G. Washing: washing the wiper after cutting in an environment above ISO 5 class according to ISO 14644-1 standard, by using a roller or spray washing, for 3 to 5 times, 5 to 10 minutes each time, wherein the bath ratio of wiper to washing solution is 1:10 to 1:20;

H. Drying: drying the washed wiper at a temperature of 70° C. to 95° C., using purified hot gas spraying process or a roller;

I. Packaging: packaging the wiper in the cleanroom above ISO 5 class according to ISO 14644-1 standard, preferably above ISO 4 class according to ISO 14644-1 standard.

Preferably, the grey fabric in step B has yarn densities as follows: warp density is between 150 to 230 yarns/inch, preferably 180 yarns/inch; weft density is between 80 to 120 yarns/inch, most preferably 100 yarns/inch.

Preferably, the rinsing process in step C is performed in an environment above ISO 8 class according to ISO 14644-1 standard, the pure water, the resistance of which is more than 18M ohm, is selected from RO (reverse osmosis) water or ultrapure water. In step C, the grey fabric is circulated 5 to 12 times in the high temperature pure water.

Preferably, if the yarns are microfibers, the rinsing effect will be optimum when the water temperature in step C is 110° C.±3° C. if the yarns are Dacron™ (polyester), the rinsing effect will be optimum when the water temperature in step C is 100° C.±3° C.

Preferably, the surfactant is 0.3% by weight, the enzyme catalyst is just a small amount, the sodium carbonate is 0.5% by weight, the sodium percarbonate is 0.5% by weight, the sodium hydroxide is 10 g/L.

Preferably, the dehydrating rotating speed of the rotating centrifugal purification dehydrator in step D is 400 rpm.

Preferably, the temperature of the setting in step E is 200° C., and the setting speed is 45 m/min.

Preferably, a nonvolatile residue test is applied on the wiper manufactured through step A to step I, the NVR value of the wiper is not more than 0.05 mg/g. A liquid particles test is applied on the wiper manufactured through step A to step I, the LPC value of the wiper is not more than 50 counts/$cm^2$.

The present invention provides a production method of superclean wiper, the rinsing process of the woven grey fabric is the key process in the whole production process. In the rising process, the airflow rinsing machine is used to rinse the grey fabric, avoiding the reverse contamination during washing and unwanted damage due to overmuch process circulation, and ensuring a high cleanliness of grey fabric after rinsing. Excellent effect of removing oligomers and particles will be achieved through adding degreasers of specific formula into the airflow rinsing machine, in a clean environment, at a specific temperature, whereby a wiper product with stable quality, i.e., a real superclean wiper, will be obtained. The rising process is simple and highly efficient, it ensures the stability of product quality and high cleanliness, producing a superclean wiper with high cleanliness and stable quality, using a simple and efficient production process.

BRIEF DESCRIPTION OF THE DRAWINGS

FIG. 1 illustrates a schematic diagram of the technological process of the production method of superclean wiper according to one example of the present invention.

The present invention will be further described in detail hereinafter with reference to the accompanying drawing.

DETAILED DESCRIPTION OF THE INVENTION

It should be understood that the preferred embodiment discussed herein are only for illustrating the present invention, but not to limit the invention.

As shown in FIG. 1, an example of the production method of a superclean wiper according to the present invention is provided here, the method comprises steps of A. choosing filaments;

B. weaving;

C. removing oligomers and dust particles through rinsing process;

D. dehydrating;

E. setting;

F. cutting;

G washing;

H. drying; and

I. packaging.

The step A to step I are described in detail as follows.

Step A. Choosing filaments: choose continuous filament yarn above AA grade, wherein the oil content of yarn is lower than 1.5%.

Step B. Weaving: weave the filament from step A to form a grey fabric, in the environment of ISO 1 to ISO 9 class according to ISO 14644-1 standard, wherein ISO 9 classis the most clean class, and the environment should be as clean as possible. The fabric is woven by a weave of 28-42 stitches, a double weave, a weave of 1/1, 1/2 or 1/3, or any combination thereof. Wherein the specific number of stitches can be selected based on the actual requirement. The greyfabric has yarn densities as follows: warp density is between 150 to 230 yarns/inch, preferably 180 yarns/inch; weft density is between 80 to 120 yarns/inch, preferably 100 yarns/inch.

Step C. Removing oligomers and particles through rinsing process: rinse the grey fabric from step B circularly by high temperature pure water, using an airflow rinsing machine without reverse contamination as a boiling-off rinsing equipment, at a water temperature of 80° C. to 130° C. If the yarns are superfine fibers, the rinsing effect will be optimum when the water temperature in step C is 110° C.±3° C. If the yarns are Dacron™ (polyester), the rinsing effect will be optimum when the water temperature in step C is 100° C.±3° C. Add degreasers, such as surfactant, enzyme catalyst, sodium carbonate, sodium percarbonate, or sodium hydroxide, in order to remove oligomers, wherein the surfactant is 0.1% to 0.8% by weight, the sodium carbonate is 0.2% to 1% by weight, the sodium percarbonate is 0.2% to 1% by weight, the sodium hydroxide is 5 g/L to 20 g/L. Preferably the surfactant is 0.3% by weight, the enzyme catalyst is just a small amount, the sodium carbonate is 0.5% by weight, the sodium percarbonate is 0.5% by weight, the sodium hydroxide is 10 g/L. The bath ratio of grey fabric to the rinsing solution is 1:3 to 1:10, the rinsing process is performed in an environment above ISO 8 class according to ISO 14644-1 standard, the pure water is selected from RO (reverse osmosis) water or ultrapure water, the grey fabric is circulated 5 to 12 times in the high temperature pure water, certainly the number of circulation will depends on the cleanliness of the grey fabric.

Rinsing conditions, such as temperature, lasting time, etc., and the formula of degreaser are determined by more experiments through computer process, whereby the optimum effect of rinsing process will be obtained, such that the oligomers and particles can be efficiently removed, and a high cleanliness of the grey fabric after rinsing will be achieved.

An ordinary overflow rinsing machine will carry various contaminants after a long-term use, and the contaminants can contaminate the grey fabric easily during rinsing process, leading to a reverse contamination. In the present invention, an airflow rinsing machine is used to rinse the grey fabric, avoiding the reverse contamination during rinsing process, ensuring a high cleanliness of grey fabric after rinsing process.

In addition, the rinsing process for the woven grey fabric is the most important process during the production of wiper. In the rising process, airflow rinsing machine is used to rinse the grey fabric, avoiding the reverse contamination during rinsing process, and ensuring the high cleanliness of grey fabric after rinsing. Meanwhile excellent effect of removing oligomers and particles will be achieved by adding degreasers of specific formula into the airflow rinsing machine, in a clean environment, at a specific temperature, whereby a wiper product with stable quality, i.e., real superclean wiper, will be obtained. The rising process is simple and highly efficient, it ensures the stability and high cleanliness of the product, making a real superclean wiper having high cleanliness and stable quality, using a simple and efficient process.

Step D. Dehydrating: dehydrate the oligomer-free and dust-free grey fabric by using a rotating centrifugal purification dehydrator, wherein the rotating centrifugal purification dehydrator has a dehydrating part made of 316 stainless steel, the dehydrating rotating speed is 350 to 600 rpm, preferably 400 rpm. Ions, dust particles and other dirt can be removed from the fiber surfaces of grey fabric efficiently.

Step E. Setting: set the grey fabric by using a dust-free and silicone oil-free setting machine in an environment above ISO 8 class according to ISO 14644-1 standard in the totally-enclosed mode, at a temperature from 160° C. to 210° C., preferably 200° C., with a setting speed of 30 to 60 m/min, preferably 45 m/min.

Step F. Cutting: put the gray fabric after setting into a cleanroom above ISO 7 class according to ISO 14644-1 standard, and cut the grey fabric through ultrasonic wave cutting, laser cutting or thermal cutting, to form a preliminary wiper;

Step G. Washing: wash the wiper after cutting in an environment above ISO 6 class according to ISO 14644-1 standard, by using a roller or spray washing, for 3 to 5 times, 5 to 10 minutes each time, wherein the bath ratio of wiper to washing solution is 1:10 to 1:20.

Step H. Drying: dry the washed wiper at a temperature of 70° C. to 95° C., using purified hot gas spraying process or a roller.

Step I. Packaging: package the wiper in the cleanroom above ISO 5 class according to ISO 14644-1 standard, preferably above ISO 4 class according to ISO 14644-1 standard.

The environment for packing can be chosen according to actual requirement for products. After the packaging process, the production process of wiper is finished.

Nonvolatile residue test (NVR test) is a test method to measure the content of nonvolatile residues on the wiper. When testing, a certain amount of solvent is used to immerse a predetermined tested cloth, then collect the solution, evaporate the solvent, and weight the residue using a micro balance, whereby the NVR value can be obtained (the detailed method is performed according to IESTCC004.3) after conversion. NVR test is applied on the wiper manufactured by the above processes, NVR value of the wiper is 0.03 mg/g, and it is obvious that such NVR value is no more than 0.05 mg/g, so its cleanliness is better than the industry standard.

Liquid particles test (LPC test) is an important method to measure the cleanliness of wiper. LPC test is applied on the wiper manufactured by the above processes, the LPC value of wiper is not more than 28 counts/cm$^2$, and it is obvious that such LPC value is not more than 50 counts/cm$^2$, so the cleanliness is better than the industry standard.

It is certified by the NVR and LPC test that the cleanliness of wiper manufactured by the production process according to the present invention is greatly better than the relevant standard of the wiper, and such wiper is a real superclean wiper.

The embodiments described hereinbefore are merely preferred embodiments and not for purposes of any restrictions or limitations on the invention. Therefore, equivalent reconfiguration according to the description and drawings of the present invention, or by directly or indirectly applying other relevant technical field, may be incorporated into ambit of the present invention.

What is claimed is:

1. A production method of superclean wiper, comprising:

choosing a continuous filament yarn above AA grade, wherein an oil content of the continuous filament yarn is lower than 3.5%;

weaving the continuous filament yarn to form a grey fabric, in an environment of ISO 1 to ISO 9 class according to ISO 14644-1 standard, the grey fabric woven by a weave of 28-42 stitches, a double weave, a weave of 1/1, 1/2 or 1/3, or any combination thereof;

removing oligomers and particles through a rinsing process, said rinsing processing comprising:

rinsing the grey fabric circularly by high temperature pure water, in an environment above ISO 8 class according to ISO 14644-1 standard, wherein the pure water, the resistance of which is more than 18M ohm, is selected from reverse osmosis water or ultrapure water, the grey fabric is circulated 5 to 12 times in the high temperature pure water;

using an airflow rinsing machine without reverse contamination as a boiling-off rinsing equipment, at a water temperature of 80° C. to 130° C.;

adding degreasers, wherein a bath ratio of grey fabric to rinsing solution is 1:3 to 1:10; and removing oligomers and particles on the grey fabric in a high temperature condition by using the airflow rinsing machine;

dehydrating the grey fabric, which is oligomer-free and dust-free, by using a rotating centrifugal purification dehydrator, and removing ions, particles and other dirt from fiber surfaces of the grey fabric, wherein the rotating centrifugal purification dehydrator has a dehydrating part made of 316 stainless steel, and its dehydrating rotating speed is 350 to 600 rpm;

setting the grey fabric by using a dust-free and silicone oil-free setting machine in an environment above ISO 8 class according to ISO 14644-1 standard, in a totally-enclosed mode, at a temperature from 160° C. to 210° C., with a setting speed of 30 to 60 m/min;

cutting the grey fabric by ultrasonic wave cutting, laser cutting or thermal cutting in a cleanroom above ISO 7 class according to ISO 146441-1 standard, to form a preliminary wiper;

washing the wiper in an environment in or above ISO 5 class according to ISO 14644-1 standard, by using a roller or spray washing, for 3 to 5 times, 5 to 10 minutes each time, wherein a bath ratio of the wiper to a washing solution is 1:10 to 1:20;

drying the wiper at a temperature of 70° C. to 95° C., by using a purified hot gas spraying process or a roller; and packaging the wiper in a clean room above ISO 5 class according to ISO 14644-1 standard.

2. The production method of claim 1, wherein said grey fabric during said weaving the continuous filament yarn has yarn densities as follows: a warp density of 150 to 230 yarns/inch and a weft density of 80 to 120 yarns/inch.

3. The production method of claim 1, wherein said dehydrating rotating speed of said rotating centrifugal purification dehydrator is 400 rpm.

4. The production method of claim 1, wherein said temperature during said setting the grey fabric is 200° C. and the setting speed is 45 m/min.

5. The production method of claim 1, further comprising:

applying a nonvolatile residue test on the wiper, wherein a residual amount of nonvolatile residues of the wiper is not more than 0.05 mg/g; and applying a liquid particles test on the wiper, wherein a residual amount of liquid particle residues of the wiper is not more than 50 counts/cm$^2$.

6. The production method of claim 1, wherein said packaging comprises packaging the wiper in a cleanroom above ISO 4 class according to ISO 14644-1 standard.

7. The production method of claim 1, wherein the degreaser is selected from a group consisting of 0.1 wt. % to 0.8 wt. % of surfactant, enzyme catalyst, 0.2 wt. % to 1% wt.

% of sodium carbonate, 0.2 wt. % to 1 wt. % of sodium percarbonate and 5 g/L to 20 g/L of sodium hydroxide.

8. The production method of claim 2, wherein the warp density is 180 yarns/inch and the weft density is 100 yarns/inch.

9. The production method of claim 1, wherein, if the grey fabric is made of superfine fibers, said rinsing process comprises rinsing at a water temperature of 110° C.±3° C., and wherein, if the greyfabric is made of polyester, said rinsing process comprises rinsing at a water temperature of 100° C.±3° C.

10. The production method of claim 7, wherein the degreaser is selected from a group consisting of 0.3 wt. % of surfactant, enzyme catalyst, 0.5 wt. % of sodium carbonate, 0.5 wt. % of sodium percarbonate and 10 g/L of sodium hydroxide.

* * * * *